United States Patent [19]

Slavinski

[11] 4,004,595

[45] Jan. 25, 1977

[54] HAIR ROLLERS

[76] Inventor: Antoni Slavinski, 5 Avondale Drive, Holcombe Brook, Bury, Lancashire, England

[22] Filed: May 23, 1975

[21] Appl. No.: 580,684

[30] Foreign Application Priority Data

May 28, 1974 United Kingdom ..... 23652/74

[52] U.S. Cl. ..... 132/40

[51] Int. Cl.[2] ..... A45D 2/00

[58] Field of Search ..... 132/40, 42, 39

[56] References Cited

UNITED STATES PATENTS

| | | | |
|---|---|---|---|
| 3,050,070 | 8/1962 | Sidelman | 132/39 |
| 3,057,365 | 10/1962 | Buzzelli et al. | 132/40 |
| 3,064,659 | 11/1962 | Solomon | 132/40 |
| 3,209,766 | 10/1965 | Dannat | 132/40 |
| 3,275,007 | 9/1966 | Thackery | 132/40 |
| 3,399,684 | 9/1968 | Meli | 132/40 |
| 3,421,523 | 1/1969 | Owens et al. | 132/40 |

*Primary Examiner*—G.E. McNeill

*Attorney, Agent, or Firm*—Prutzman, Hayes, Kalb & Chilton

[57] ABSTRACT

A hair roller which has a pronged retention member mounted at at least on one end. The retention member is movable axially between one position at which hair can be wound around or unwound from the roller and a further position at which the prongs engage hair wound around the roller to hold same in place. In the latter position the prongs are inclined outwardly away from the roller axis so that they can be pushed through and over the hair on the roller and can penetrate in towards the users scalp.

14 Claims, 3 Drawing Figures

HAIR ROLLERS

This invention relates to hair rollers, that is, devices having body parts which are usually of generally cylindrical form and around which a person's hair can be wound to facilitate styling or shaping thereof.

In use, it is desirable to hold the hair securely in position around a hair roller and with a view to achieving this it is known to use separate securing devices such as hair clips and/or to form the roller with prominently projecting spines or the like which mesh with the hair. These known arrangements however have the disadvantage that positioning and removal of the roller may be inconvenient and time consuming and/or may cause discomfort to the user. In addition, the separate securing devices may cause marking of the hair.

It is also known to use a hair roller which has a pronged retention member mounted at each end, said member being movable axially between positions at which the prongs extend over and are retracted away from the central body part of the roller. A hair roller of this kind is disclosed in U.S. Pat. No. 3,209,766. With this arrangment hair can be secured in position and released as desired in a quick and convenient manner, by appropriate movement of the retention members. However with the roller described in the U.S. Patent the prongs, when extended, lie in close juxtaposition to the body parts and the problem therefore arises that a thick roll of hair cannot be easily accommodated or securely held in position. In addition, in order to ensure secure retention of hair without trapping same it is necessary to ensure that the hair is wound around the central part of the roller and not around the ends thereof. Further, the problem of marking also arises with this roller.

The primary object of the present invention is to provide a hair roller which can be securely positioned and removed in a quick and convenient manner without causing undue discomfort to the user irrespective of the thickness of the hair, and with which marking of the hair can be avoided or at least minimised.

According to the present invention therefore there is provided a hair roller having a body part with an outer periphery around and in contact with which hair can be wound, and at least one retention member mounted at an end of the said body part and movable relative thereto between a first position at which hair wound around the body part can be retained in position thereon and a second position at which said hair is free to be unwound from the body part, the retention member comprising a support structure and a plurality of prongs mounted on and projecting from said structure, the prongs being arranged to extend over said periphery of the body part in the said first position and being arranged to be retracted away from said periphery in the said second position, and the said prongs being arranged to be inclined outwardly away from the axis of the body part in the said first position.

With this arrangement, the outward inclination of the prongs in the said first position acts to direct the prongs, in use, through and over hair wound around the body part. Essentially therefore the prongs can act as pins connected to the roller and pushed through the users hair towards the users scalp whereby the hair is held in place by obstruction of the same against unwinding rather than by compression of the hair between the prongs and the roller. It will therefore be appreciated that the problems which arise with an arrangement involving compression, such as discomfort to the user, marking of the hair, limitation of the bulk of hair which can be accommodated on the roller and the problems of securing the hair in place when the hair overlies the ends of the roller, can be avoided or at least appreciably reduced. In addition with penetration of the prongs through the hair towards the users scalp the roller can be held in position relative to the scalp as well as being held in position relative to the hair wound therearound, and drying of the hair can be facilitated by virtue of the formation of passages in the hair by the prongs. Preferably the prongs are deflectable outwardly when in said first position whereby movement of the prongs through and over hair on the roller is further facilitated.

The prongs may be resiliently deflectable and/or each prong may be connected to the support structure via a hinge joint so as to be deflectable about the joint. The hinge joint may take the form of a constriction or the like in the prong.

Preferably the said inclination of the prongs is adopted as the prongs are moved into the said first position, the prongs being less inclined or not inclined at all when in said second position, whereby it will be appreciated that the prongs can move smoothly through and over hair wound around the body part as the prongs are moved from the first to the second position.

Preferably also, the said end of the body part has a tubular member thereat and the said support structure is slidable within said member between the said first and second positions. With this arrangement it will be seen that movement of the retention member can be effected in a quick and easy manner, even when the hair is wound around the ends as well as the body part of the roller. The support structure may be arranged to project from the tubular member in the second position whereby the end of the roller is effectively extended and can be gripped more easily.

The support structure may be a sleeve arranged coaxially within the tubular member and the sleeve may have the prongs at one end and a finger opening at its opposite end whereby movement of the sleeve in the tubular member can be effected by means of a simple finger movement.

The retention member may be spring loaded or otherwise biased towards the said second position and a catch or the like may be provided for holding the member in the said first position. Alternatively, an opposite arrangement may be employed, that is, a catch or the like may be provided for holding the retaining member in the second position and the retaining member may be biased towards or readily movable towards and retainable in the first position.

The catch may comprise a movable element engageable with an abutment whereby release of the catch is effected by manual displacement of the movable element. Alternatively, interengageable structures such as snap fitting structures may be employed.

The body part may be provided with projecting spines or the like to facilitate anchoring of hair therearound. Such spines may be formed on the body part or may be provided on a separate member such as a brush member located relative to the body part. In accordance with a preferred embodiment, the body part comprises a generally cylindrical cage structure and a brush member is provided for positioning therewithin, the brush member having bristles or spines which are arranged to project through and slightly beyond the cage walls. Conveniently, the cage structure may be formed from two end structures and a generally cylindrical arrangement of elongated elements extending therebetween.

Further, the cage structure may be formed in two detachable parts to facilitate insertion and removal of the brush member.

The invention will now be described further by way of example only and with reference to the accompanying drawings in which.

Figure 1:
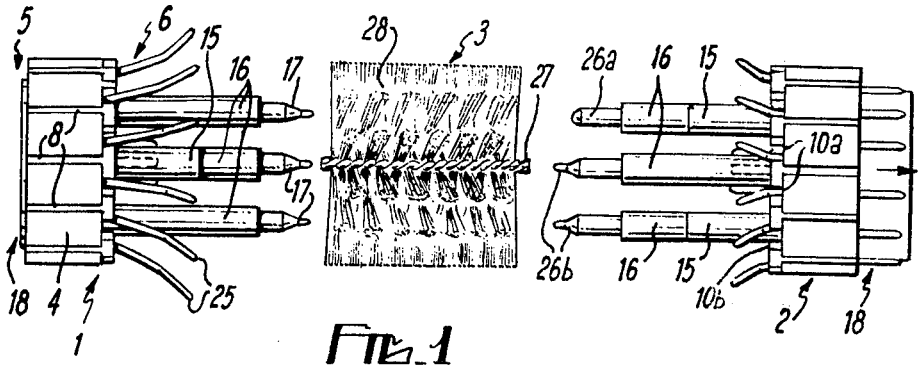
FIG. 1 is an exploded view of one form of a hair roller according to the present invention, with the parts thereof shown at the extreme left and extreme right being in different operational positions.
Figure 2:
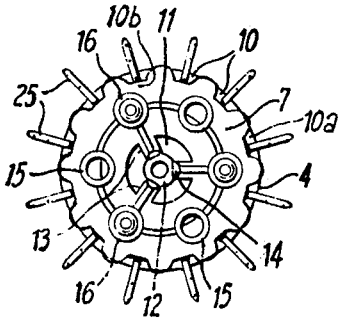
FIG. 2 is an axial view from the right of the part of the hair roller shown at the extreme left of FIG. 1.

The hair roller is made up of two structural parts 1,2 shown respectively at the extreme right and the extreme left of FIG. 1, and a brush member 3 shown in the centre of FIG. 1. The left part 1 comprises a short cylindrical plastics member 4 which is open at one end 5 and has an integral end plate 7 (FIG. 2) across its other end 6.

Figure 3:
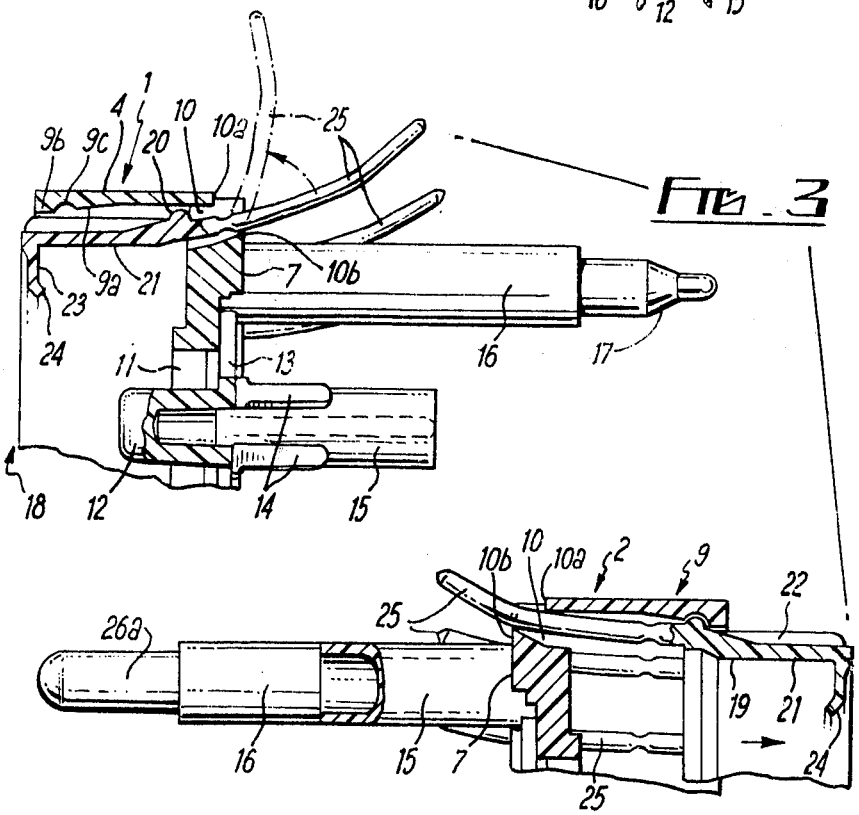
FIG. 3 is an axial sectional view of the parts shown at the extreme left and extreme right of FIG. 1.

The outer surface of the member 4 has axially extending ribs 8 spaced around the circumference thereof and the inner surface is smooth except for a ridge 9 adjacent the open end of the member (FIG. 3). The ridge has a smooth ramp portion **9*a* at its innermost periphery, and an abutment portion 9*b* at its outermost portion, a shallow recess 9*c* being defined between said portions 9*a*, 9*b***.

The end plate 7 is provided with a plurality of openings 10 therein at positions spaced around the radially outer periphery thereof. The end plate 7 also has a central aperture 11 and a cap member 12 is secured in the centre of such aperture 11 by three radially extending spider elements 13. Three prongs 14 are formed integrally with and project axially from the cap member 12.

At circumferentially spaced positions around the end plate 7 there are six integrally formed axially extending tubular member 15,16. Three of the members 15 are open ended tubes and the other three members 16, which are arranged alternately with the first said members 15, terminate in tapered ends 17 and are longer than the first said members 15.

Within the cylindrical member 4 there is arranged an inner plastics sleeve member 18 which has an inner end part 19 having a thickened wall and terminating in an outwardly directed lip 20, and an outer end part 21 having a thinner wall provided with ribs 22 on its outer surface and terminating in an inwardly directed flange 23. The flange is inclined axially inwardly and has an inwardly turned rim 24 at its radially inner periphery.

The sleeve 18 is movable axially within the member 4 between an innermost position (as shown at the left of FIG. 1) at which the lip 20 abuts the end plate 7, and an outermost position (as shown at the right of FIG. 1) at which the lip 20 rides up the ramp **9*a* and engages the recess 9*c*, further outwards movement of the sleeve then being restricted by the abutment 9*b*. The sleeve 18 has short axially extending slots therein (not shown) at the end thereof in the region of the lip 20 whereby it is capable of slight constriction to permit easy engagement of the lip 20 with the recess 9*c***.

A plurality of springy prongs 25 are formed intergrally with the sleeve and project generally axially from the inner end thereof. The prongs project through the apertures 10 and, as can be seen from the drawings, when the sleeve 18 is in its innermost position almost the entire lengths of the prongs project from the apertures, and when the sleeve is in its outermost position, the tips of the prongs project from the apertures.

The prongs 25 are formed from a resiliently deflectable material and are also independently deflectable about hinge joints, formed by creases, constrictions or the like adjacent the roots of the prongs formed for example by bending the prongs back over the outer surface of the sleeve during the final stage of formation of the prongs. The prongs 25 are also shaped so that when not deflected the free end portions thereof are inclined at an angle of about 30° to the axis of the sleeve 18 and the remaining portions thereof are inclined at an angle of about 15° to such axis. In fact the formation of such remaining portions is such that there is a progressive increase in the angle of inclination towards the free end portions. As the sleeve 18 is moved to the outermost position (at the right of FIG. 1) the prongs 25 engage the radially outer edges **10*a* of the apertures 10 and are deflected inwards so that the prongs 25 extend more nearly parallel to the sleeve axis. As the sleeve 18 is moved to the innermost position the prongs 25 engage the radially inner edges 10*b* of the apertures 10, which edges are raised slightly, so that the prongs 25** are deflected outwards.

When the sleeve 18 is in the outermost position, as shown in dotted lines at the left of FIG. 3, the prongs can be moved independently outwards about the hinge joints to positions at which the prongs are approximately perpendicular to the sleeve axis, the outer edges **10*a* of the apertures being cut back to permit this. Movement of the prongs about the hinge joints in an inward direction is limited by engagement of the prongs with the raised edges 10*b*, the hinge joints being arranged at the inner sides of such edges 10*b***.

In the outermost position of the sleeve 18, the sleeve is held in position by the snap-fit action of the lip 20 and recess **9*c*. In the innermost position, the sleeve is retained against movement to the outermost position by abutment of the prongs 25 with the edges 10*a*, the resilience of the prongs and hinge joints being sufficient to offer slight resistance to movement of the sleeve 18**.

The right part 2 is identical with the left part 1 so far described except that the tapered ends 26 of the longer members 16 are longer than the corresponding tapered ends of the other part, and one such tapered end **26*a* is slightly shorter and is less pointed than the other two ends 26*b***.

The brush member 3 comprises a central rigid support 27 formed from wires twisted together, and bristles or spines 28 secured between the twisted wires and projecting therefrom along its entire length and around its entire periphery.

The hair roller so far described is assembled in the following manner.

One end of the central support 27 of the brush member is inserted into the end cap 12 and prongs 14 of one of the structural parts, say the left part 1. The prongs 14 deflect outwardly slightly to receive the end of the brush member 3 and then, due to their resilience, grip the brush member 3 with a slight spring force.

The other part 2 is then moved into position so that the tapered ends 17,26 of the longer member 16 of each part 1,2 are aligned with the short open ended members 15 of the other of the parts 1,2. The parts 1,2 are then moved axially together until the tapered ends 17,26 enter the respective tubular members 15. The tapered ends 17,26 are formed so that snap-fit engagement is achieved between the members. The difference in lengths of the various tapered ends 17,26 facilitates simultaneous interengagement of all such ends with the members even if some of the members 15,16 are slightly out of alignment.

When the parts 1,2 are secured together as described, the other end of the brush member 3 engages in the cap 12 and prongs 14 of the other part 2. The members 15,16 then define a cage structure in which the brush member 3 is enclosed with the bristles or spines of the brush member projecting between and slightly beyond the members.

In use, hair is wound around the cage structure and projecting bristles with the sleeves 18 in their axially outermost positions and with the prongs 25 therefore retracted, as shown on the right side of FIG. 1. In the retracted position, as already mentioned, the prongs 25 project slightly and this ensures that the hair becomes wound evenly around the central body part of the roller, the tips of the prongs and the tubular members 4, rather than tending to fall between the members 4. The sleeves 18 project freely from the members 4 and this facilitates gripping of the roller as the hair is being wound around same.

When the hair is in the desired position, the sleeves 18 are moved inwardly to their innermost positions whereupon the prongs 25 are moved into engagement with the hair so as to hold same securely in position. The prongs 25 move outwardly due to the resilience thereof and due to the action of the edges 10*b*, as the sleeves move towards the innermost positions, and this causes the prongs to smoothly and evenly penetrate the hair lying over the tips of the prongs 25. The progress increase in inclination of the prongs facilitates this action. Further, as the prongs 25 are moved out away from their retracted position to the position shown at the left of FIG. 1, the prongs are deflected due to their resilience and also due to the hinge joints over the bulk of hair wound around the roller towards the scalp. Penetration of the hair and deflection of the prongs thereover is further facilitated by the fact that the prongs have free end portions which are inclined outwardly to a greater extent than the remaining portions thereof and due to the resilience of the prongs.

It will therefore be appreciated that the hair roller described above can be fitted quickly and easily irrespective of the bulkiness of the hair wound around the roller and without causing discomfort to the user.

Further the manner of penetration of the prongs in the hair towards the scalp reduces the likelihood of marking and acts to locate the roller relative to the scalp in such a manner as to prevent rolling movement of the roller on the scalp. In this respect the prongs can adapt to the shape of the scalp and overlying hair due to the fact that they are freely independently deflectable. It will further be noted that the prongs do not act to press the hair against the roller but lightly ride over the hair and obstruct unwinding of same. In addition penetration of the hair by the prongs facilitates drying of the hair. Drying is also facilitated by the presence of the ridges 8 which hold the hair slightly away from the outer surfaces of the members 4.

The sleeves 18 fit within the members 4 and this ensures that hair wrapped around the roller does not obstruct movement of the retention members. There is a slight clearance between the sleeves 18 and the members 4 which is sufficiently small to ensure smooth even sliding of the sleeves 18 but which is large enough to ensure that hair cannot become trapped between the sleeves 18 and members 4.

In addition, the inclined, rimmed flanges give good finger location whereby each sleeve 18 can be moved with one finger (say the forefinger) whilst the adjacent member 4 is gripped between, say, thumb and middle finger of the same hand. Movement of the sleeves to secure or release the hair can therefore be achieved quickly and easily and with little more than finger movement.

Movement of the sleeves is further facilitates by the interengagement of the lip 20 and the ridge 9 in that, as the sleeves are pushed inwards, the lips thereof move onto the ramp, and the action of this together with the resilience of the prongs is such as to assist inwards movement of the sleeves. In the innermost position, the sleeves are held in position by engagement of the prongs with the edges of the apertures 10. In the outermost position, the interengagement of the lips 20 and ridges 9, which is of the nature of a snap-fit, ensures that the sleeves are held securely in position whilst hair is wound around the roller whilst enabling the sleeves to be moved inwards when required with a simple, quick and positive action.

The brush member 3 is held firmly in position within the cage structure defined by the members 15,16 by virtue of the prongs 14 and this gives firmly positioned bristles projecting from the cage structure. This ensures that the hair can grip well on the roller and also enables the roller to be used in the manner of a brush to facilitate styling of the hair and fitting of the roller.

It is of course to be understood that the invention is not intended to be restricted to the details of the above embodiment which are described by way of example only. Thus, for example, if desired the brush member may be omitted and instead spines or the like may be provided as an integral part of the body of the roller or may be omitted altogether. Further, additionally or alternatively to the provision of any spines, the members 15,16 may be roughened to give good grip of the hair on the roller.

What I claim is:

1. A hair roller comprising a body part having an axis, two axially spaced ends and an outer periphery around and in contact with which hair can be wound, and at least one retention member mounted at one said end of the said body part and movable axially relative thereto between a first position at which hair wound around the body part can be retained in position thereon and a second position at which said hair is free to be unwound from the body part, the retention member comprising a support structure and a plurality of prongs mounted on and projecting from said structure, the prongs being arranged to extend over said periphery of the body part in the said first position and being arranged to be retracted away from said periphery in the said second position, and the said prongs being arranged to be inclined outwardly away from said axis of the body part in the said first position, the body part comprising a cage structure and a brush member arranged within the cage structure having spines projecting out of same, the body part having end members and a plurality of elongated elements extending in side-by-side spaced disposition between the end members, each comprising two parts detachably interconnectable with each other at free ends thereof remote from the end members.

2. A hair roller having a body part with an outer periphery around and in contact with which hair can be wound, and at least one retention member mounted at an end of the said body part and movable relative thereto between a first position at which hair wound around the body part can be retained in position thereon and a second position at which said hair is free to be unwound from the body part, the retention member comprising a support structure and a plurality of prongs mounted on and projecting from said structure, the prongs being arranged to extend over said periphery of the body part and to be inclined outwardly away from the axis of the body part in the said first position and being arranged to be retracted away from said periphery in the said second position, each prong being connected to the support structure via a hinge joint so as to be deflectable outwardly about said joint when in the said first position.

3. A hair roller according to claim 2 wherein each prong is deflectable as aforesaid in a resilient manner.

4. A hair roller according to claim 2 wherein the prongs are shaped so as to adopt a greater inclination at the free end portions than at the remaining portions thereof when in said first position.

5. A hair roller according to claim 2 wherein there is provided a first abutment means on the body part arranged to direct displacement of the prongs to said inclined dispositions thereof as the retention member is moved to said first position.

6. A hair roller according to claim 2 wherein the prongs are arranged to extend partially over the said periphery in the said second position.

7. A hair roller according to claim 2 wherein the said end of the body part has a tubular member thereat and the said support structure is slidable within said member between the said first and second positions.

8. A hair roller according to claim 2 wherein there is provided a catch arrangement associated with said retaining member for holding same in said second position, and the retaining member is arranged to be biased towards and retainable in said first position on release of the catch arrangement.

9. A hair roller according to claim 2 wherein the body part comprises a cage structure and a brush member is arranged within the structure with the spines projecting out of same.

10. A hair roller according to claim 5 wherein a second abutment means is provided on the body part for engagement with the prongs when inclined as aforesaid so as to direct displacement of same back towards the said periphery as the retention member is moved to the said second position.

11. A hair roller according to claim 7 wherein the support structure projects from the tubular member in the said second position.

12. A hair roller according to claim 11 wherein the said structure comprises a sleeve arranged coaxially within the said tubular member.

13. A hair roller according to claim 12 wherein the sleeve is connected to the prongs at one end and has a finger opening at its opposite end whereby movement of the sleeve in the tubular member can be effected by means of a simple finger movement.

14. A hair roller according to claim 9 wherein the body part is made up of a plurality of elongated elements extending in side-by-side spaced disposition between end members.

* * * * *